US010261448B2

(12) United States Patent
Kobayashi

(10) Patent No.: US 10,261,448 B2
(45) Date of Patent: Apr. 16, 2019

(54) ROLLER DEVICE AND IMAGE FORMING APPARATUS

(71) Applicant: FUJI XEROX CO., LTD., Tokyo (JP)

(72) Inventor: Akihiro Kobayashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/942,443

(22) Filed: Mar. 31, 2018

(65) Prior Publication Data

US 2018/0284658 A1 Oct. 4, 2018

(30) Foreign Application Priority Data

Apr. 4, 2017 (JP) ..... 2017-074293

(51) Int. Cl.
*G03G 15/16* (2006.01)

(52) U.S. Cl.
CPC . *G03G 15/1615* (2013.01); *G03G 2215/1623* (2013.01)

(58) Field of Classification Search
CPC ..... G03G 15/1615; G03G 2215/1623
USPC ..... 399/308
See application file for complete search history.

(56) References Cited

U.S. PATENT DOCUMENTS

2011/0299883 A1* 12/2011 Suzuki ..... G03G 15/0894 399/110
2015/0268609 A1* 9/2015 Yamada ..... B65H 3/00 399/328

FOREIGN PATENT DOCUMENTS

JP 2015-212748 11/2015

* cited by examiner

*Primary Examiner* — Susan S Lee
(74) *Attorney, Agent, or Firm* — JCIPRNET

(57) ABSTRACT

A roller device includes a first roller; a second roller that rotates around a rotation axis extending in a first direction and that is disposed upstream of the first roller in a second direction; a bearing that supports the second roller and includes a projection; an urging unit that urges the bearing in the second direction; and a passage member having a gap that defines first and second passages that respectively extend in the first and second directions and supporting the bearing. The projection is inserted in the gap. The bearing is movable in the first and second directions. The first and second rollers are apart from each other when the projection is in the first passage. The bearing is moved in the second direction so that the first and second rollers are pressed against each other when the projection is in the second passage.

11 Claims, 12 Drawing Sheets

ROLLER DEVICE AND IMAGE FORMING APPARATUS

CROSS-REFERENCE TO RELATED APPLICATIONS

This application is based on and claims priority under 35 USC 119 from Japanese Patent Application No. 2017-074293 filed Apr. 4, 2017.

BACKGROUND

Technical Field

The present invention relates to a roller device and an image forming apparatus.

SUMMARY

According to an aspect of the invention, there is provided a roller device including a first roller; a second roller that rotates around a rotation axis extending in a first direction and that is disposed upstream of the first roller in a second direction; a bearing that supports an end of the second roller in a rotatable manner and that includes a projection; an urging unit that urges the bearing in the second direction; and a passage member having a gap that defines a first passage that extends in the first direction and a second passage that is connected to an end of the first passage in a direction opposite to the first direction and that extends in the second direction. The passage member supports the bearing in such a manner that the projection is inserted in the gap and that the bearing is movable in the first direction and the second direction. The passage member is fixed at a position such that the first and second rollers are apart from each other when the projection is in the first passage and that the bearing, which is urged, is moved in the second direction so that the first and second rollers are pressed against each other when the projection is in the second passage.

BRIEF DESCRIPTION OF THE DRAWINGS

An exemplary embodiment of the present invention will be described in detail based on the following figures, wherein.

DETAILED DESCRIPTION

1. Exemplary Embodiment

Figure 1:
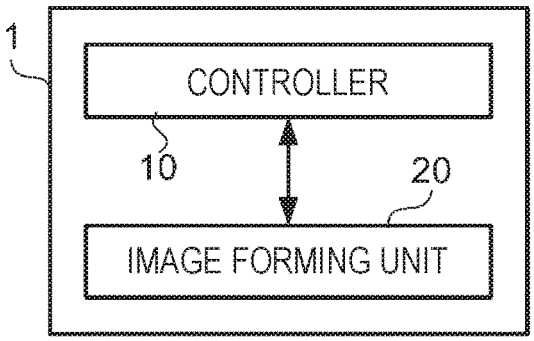
FIG. 1 illustrates the overall structure of an image forming apparatus according to an exemplary embodiment.

FIG. 1 illustrates the overall structure of an image forming apparatus 1 according to an exemplary embodiment. The image forming apparatus 1 forms a color image on a medium by using an electrophotographic system. The image forming apparatus 1 includes a controller 10 and an image forming unit 20. The controller 10 is connected to an external device by a communication line (not shown). When the controller 10 receives image data from the external device, the controller 10 converts the image data, for example, from RGB color image data to CMYK color image data. The controller 10 outputs the processed image data to the image forming unit 20.

The image forming unit 20 forms an image represented by the image data processed by the controller 10 on a medium. The image forming unit 20 forms a color image by fixing four types of toners, which are yellow (Y), magenta (M), cyan (C), and black (K) toners, to the medium.

Figure 2:
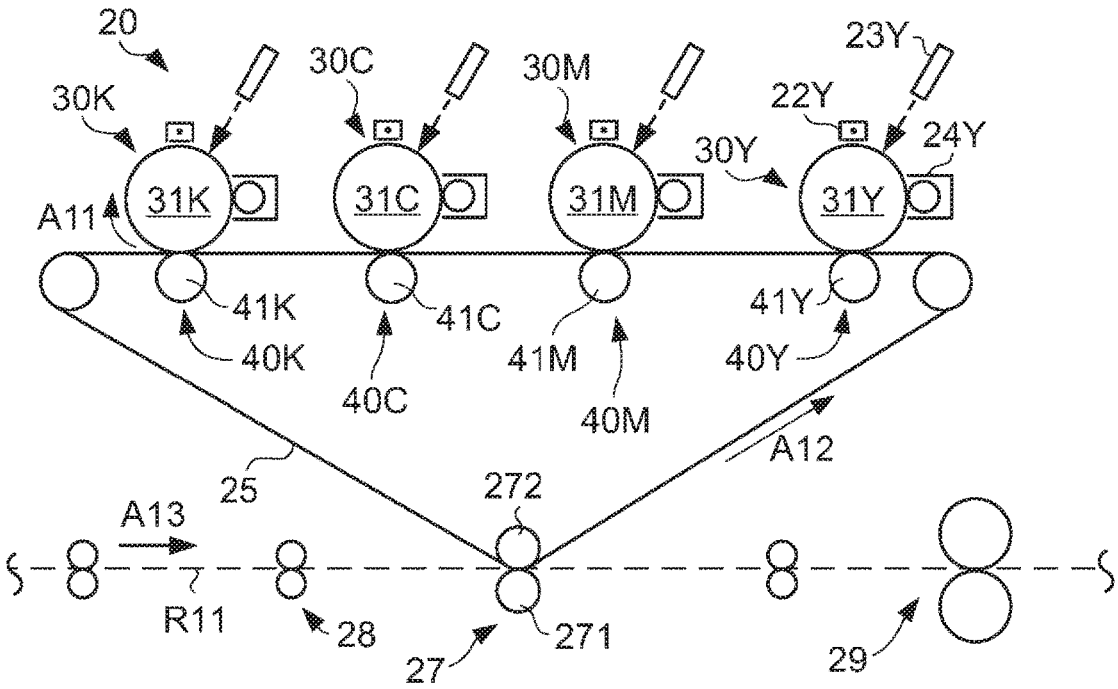
FIG. 2 illustrates the hardware structure of an image forming unit.

FIG. 2 illustrates the hardware structure of the image forming unit 20. The image forming unit 20 includes photoconductor units 30, charging units 22, exposure units 23, developing units 24, an intermediate transfer belt 25, first transfer units 40, a second transfer unit 27, a transport unit 28, and a fixing unit 29. The photoconductor units 30, the charging units 22, the exposure units 23, the developing units 24, and the first transfer units 40 are provided for the respective colors, which are Y, M, C, and K, and are arranged along the intermediate transfer belt 25.

In FIG. 2, these components are denoted by reference numerals having letters Y, M, C, and K at the end to show the colors of images formed thereby. With regard to the charging units 22, the exposure units 23, and the developing units 24, only the units for forming a yellow (Y) image are denoted by the respective reference numerals, and reference numerals of units for forming images of the other colors are omitted. The letters at the end of the reference numerals are omitted when it is not necessary to distinguish the components or when the components are generically described.

The photoconductor units 30 are provided for the respective colors, and each include a photoconductor drum 31 that carries an image formed by using toner. Each photoconductor drum 31 includes a photosensitive layer, and rotates in a rotation direction A11 while carrying a latent image (referred to also as an electrostatic latent image) or an image obtained by developing the latent image with toner on a surface of the photosensitive layer.

Each charging unit 22 charges the surface of the photosensitive layer of the corresponding photoconductor drum 31 to a predetermined potential. Each exposure unit 23 irradiates the charged photosensitive layer with exposure light whose intensity and radiation position are controlled in accordance with the image data, so that the photosensitive layer is exposed to the exposure light. Thus, a latent image corresponding to the image data is formed on the photoconductor drum 31.

Each developing unit 24 includes a developing roller that attracts and transports charged toner. A developing bias voltage is applied between the developing roller and the corresponding photoconductor drum 31, so that the toner is supplied from the developing roller to the photoconductor drum 31 and the latent image is developed. Thus, the developing unit 24 forms a visualized image at the position of the latent image by using the toner.

The intermediate transfer belt 25 is an endless belt that carries images transferred thereto from the photoconductor drums 31 in a first transfer process. The intermediate transfer belt 25 is an example of a "transfer belt" according to the present invention. The intermediate transfer belt 25 is rotatably supported by plural support rollers, and rotates in a rotation direction A12 when a driving force is applied thereto. The photoconductor drums 31 transfer Y, M, C, and K images to the intermediate transfer belt 25 in that order from the photoconductor drum 31Y in the first transfer process.

Each first transfer unit 40 includes a first transfer roller 41 that is positioned so as to oppose the corresponding photoconductor drum 31 with the intermediate transfer belt 25 interposed therebetween. The first transfer roller 41 receives force form an urging unit, which will be described below, in a direction toward the photoconductor drum 31. Accordingly, the first transfer roller 41 and the photoconductor drum 31 rotate in a pressed state in which they push each other and apply pressure to each other (the first transfer roller 41 and the photoconductor drum 31 are not in direct contact with each other in the pressed state since the intermediate transfer belt 25 is disposed therebetween).

The intermediate transfer belt 25 rotates while being interposed between each first transfer roller 41 and the corresponding photoconductor drum 31 in the pressed state. A first transfer voltage is applied between each first transfer roller 41 and the corresponding photoconductor drum 31 in the pressed state, so that the image carried by the photoconductor drum 31 is transferred to the intermediate transfer belt 25 in the first transfer process.

Each photoconductor drum 31 is an example of a "first roller" according to the present invention, and each first transfer roller 41 is an example of a "second roller" according to the present invention. Each photoconductor unit 30 and the corresponding first transfer unit 40 constitute an example of a "roller device" including two rollers, which are the photoconductor drum 31 and the first transfer roller 41, according to the present invention.

The second transfer unit 27 includes a second transfer roller 271 and a backup roller 272. The second transfer roller 271 and the backup roller 272 oppose each other with the intermediate transfer belt 25 interposed therebetween to form a nip portion. A second transfer voltage is applied between the second transfer roller 271 and the backup roller 272, so that the image carried by the intermediate transfer belt 25 is transferred to a medium that passes through the nip portion in a second transfer process.

The transport unit 28 includes plural rollers, and transports the medium in a transporting direction A13 along a transport path R1 that passes through the nip portion. The medium transported by the transport unit 28 comes into contact with the intermediate transfer belt 25 in the nip portion. The fixing unit 29 fixes the image transferred to the medium in the second transfer process to the medium.

As described above, the charging units 22, the exposure units 23, the developing units 24, the second transfer unit 27, the transport unit 28, and the fixing unit 29 are used to form an image on the medium by forming images on the photoconductor drums 31, transferring the formed images to the intermediate transfer belt 25 by applying the first transfer voltage between each photoconductor drum 31 and the corresponding first transfer roller 41, and transferring the images transferred to the intermediate transfer belt 25 to the medium by applying the second transfer voltage between the second transfer roller 271 and the backup roller 272. The above-mentioned components constitute an example of an "image forming unit" according to the present invention.

The manufacturing process of the image forming apparatus 1 includes a step of setting the first transfer roller 41 and the photoconductor drum 31 to a separated state (state in which they are apart from each other and apply no pressure to each other). When the first transfer roller 41 and the photoconductor drum 31 are in the above-described pressed state (state in which they push each other and apply pressure to each other), there is a risk that the rollers will be, for example, deformed, scratched, or contaminated. Therefore, the rollers are set to the separated state when the image forming apparatus 1 is shipped, and are switched from the separated state to the pressed state when a user starts to use the image forming apparatus 1. The structure for switching the rollers will now be described with reference to the drawings.

Figure 3A:
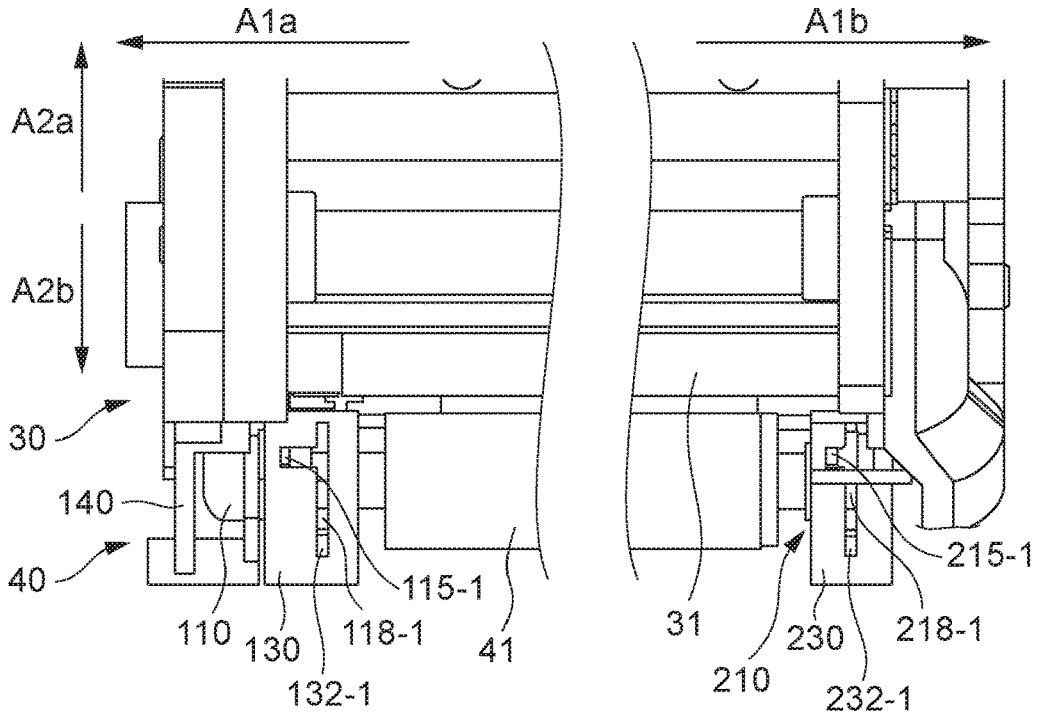
FIGS. 3A and 3B illustrate a photoconductor unit and a first transfer unit.
Figure 3B:
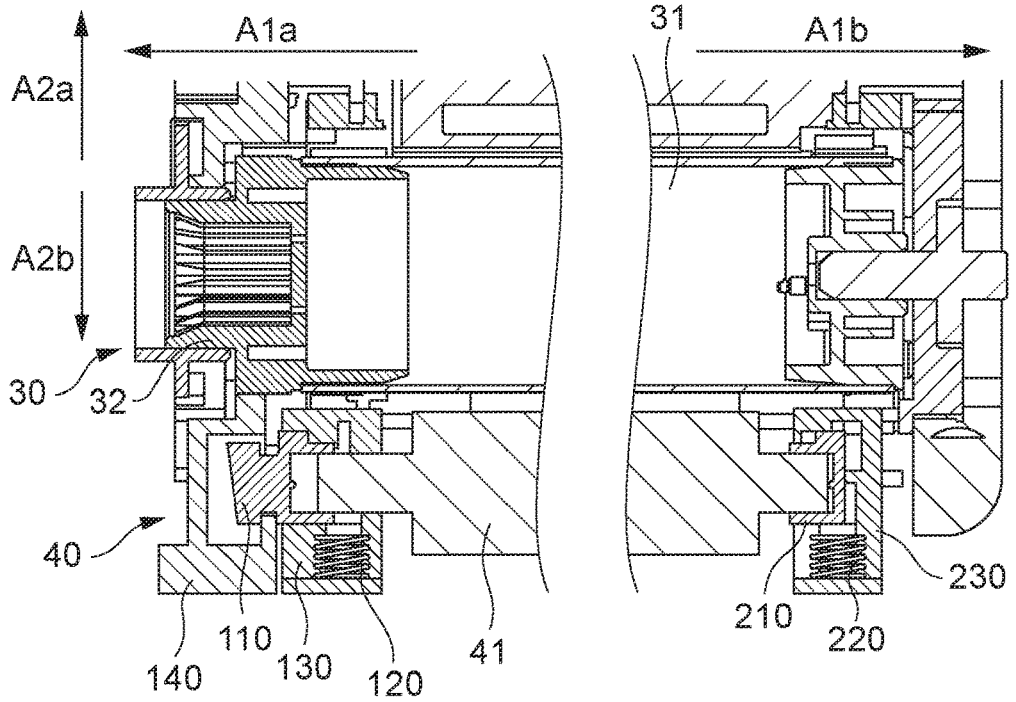

FIGS. 3A and 3B illustrate the photoconductor unit 30 and the first transfer unit 40. FIG. 3A illustrates the appearance of the units, and FIG. 3B is a sectional view of the units. FIGS. 3A and 3B show a first direction A1*a* and a second direction A2*a* that are perpendicular to each other, a first opposite direction A1*b* that is opposite to the first direction A1*a*, and a second opposite direction A2*b* that is opposite to the second direction A2*a*.

The photoconductor drum 31 included in the photoconductor unit 30 and the first transfer roller 41 included in the first transfer unit 40 are both supported such that they are rotatable around rotation axes that extend in the first direction A1*a*. The photoconductor drum 31 is disposed downstream of the first transfer roller 41 in the second direction A2*a*. In other words, the first transfer roller 41 is disposed downstream of the photoconductor drum 31 in the second opposite direction A2*b*.

The photoconductor unit 30 includes the photoconductor drum 31 and a drum gear 32. The drum gear 32 is attached to the photoconductor drum 31 at the end of the photoconductor drum 31 in the first direction A1*a*. The drum gear 32 is rotated when power is transmitted thereto from a drive unit (not shown) that generates a driving force, and accordingly the photoconductor drum 31 is rotated together with the drum gear 32.

The first transfer unit 40 includes the first transfer roller 41, a first bearing 110, a first spring 120, a first passage member 130, a switching member 140, a second bearing 210, a second spring 220, and a second passage member 230. The first bearing 110 is provided at the end of the first transfer roller 41 in the first direction A1*a*, and supports one end portion of the first transfer roller 41 in a rotatable manner. The second bearing 210 is provided at the end of the first transfer roller 41 in the first opposite direction A1*b* (end opposite to the end in the first direction A1*a*), and supports the other end portion of the first transfer roller 41 in a rotatable manner. The first bearing 110 is an example of a "bearing" according to the present invention, and the second bearing 210 is an example of a "second bearing" according to the present invention.

The first spring 120 is a coil spring that urges the first bearing 110 in the second direction A2*a*. The second spring 220 is a coil spring that urges the second bearing 210 in the second direction A2*a*. The first spring 120 is an example of an "urging unit" according to the present invention, and the second spring 220 is an example of a "second urging unit" according to the present invention.

The first bearing 110 includes a first projection 115-1 and a second projection 118-1. The second bearing 210 includes a first projection 215-1 and a second projection 218-1. The first passage member 130 has a gap 132-1 that receives the first projection 115-1 and the second projection 118-1 of the first bearing 110. The second passage member 230 has a gap 232-1 that receives the first projection 215-1 and the second projection 218-1 of the second bearing 210. The gap 132-1 defines passages along which the projections of the first bearing 110 move, and the gap 232-1 defines passages along which the projections of the second bearing 210 move.

Figure 4:
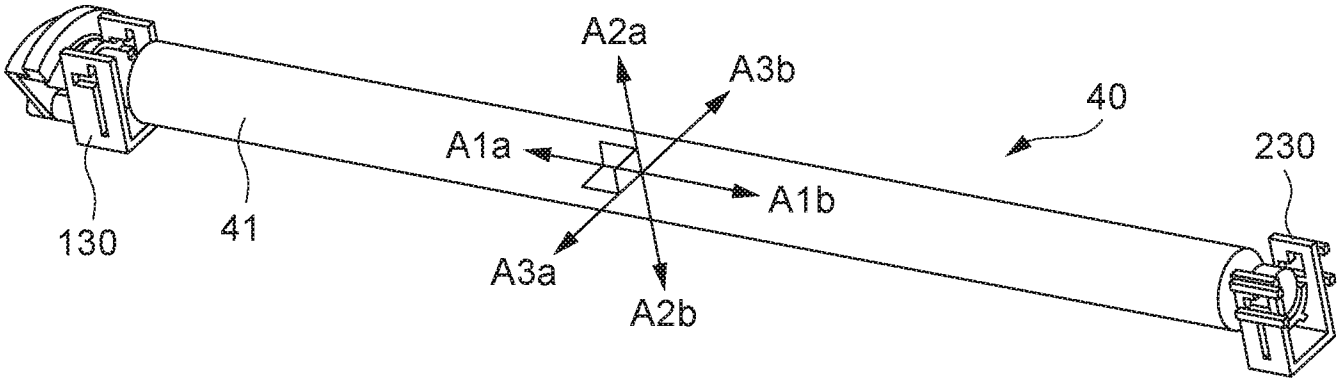
FIG. 4 illustrates the appearance of the first transfer unit.

FIG. 4 illustrates the appearance of the first transfer unit 40. Referring to FIG. 4, the first passage member 130 is provided at the end of the first transfer roller 41 in the first direction A1*a*, and the second passage member 230 is provided at the end of the first transfer roller 41 in the first opposite direction A1*b*. FIG. 4 shows a third direction A3*a* that is perpendicular to both the first direction A1*a* and the second direction A2*a* that are perpendicular to each other, and a third opposite direction A3*b* that is opposite to the third direction A3*a*. The third opposite direction A3*b* is the direction in which the first transfer roller 41 and other components are viewed in FIGS. 3A and 3B.

Figure 5:
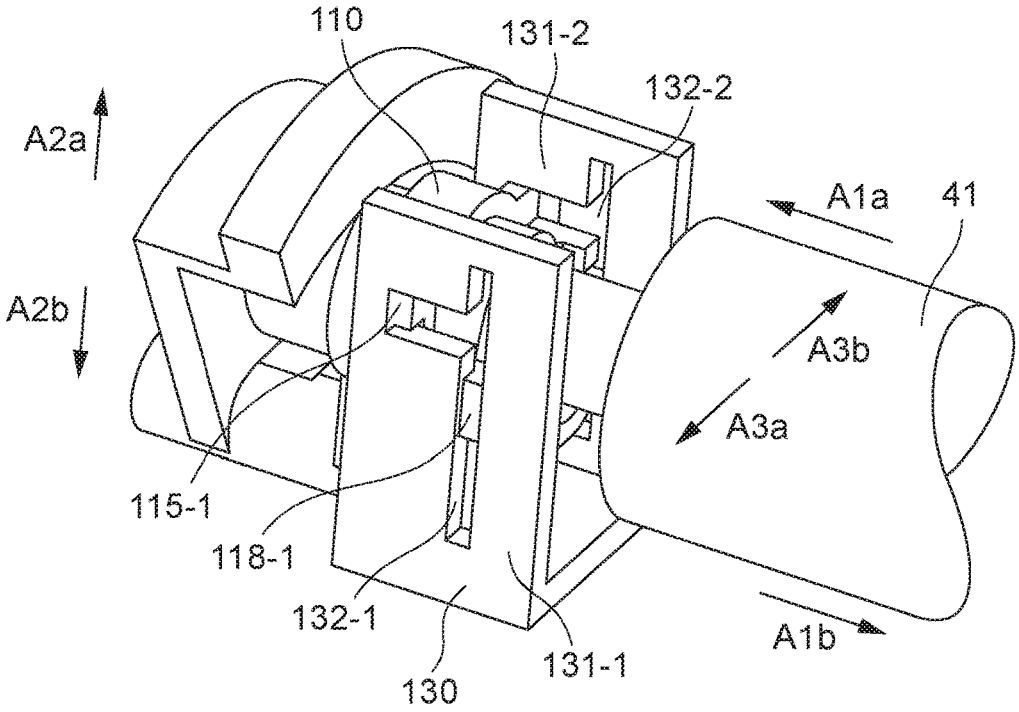
FIG. 5 is an enlarged view of a first passage member.

FIG. 5 is an enlarged view of the first passage member 130. The first passage member 130 includes a first plate portion 131-1 disposed downstream of the first bearing 110 in the third direction A3*a* and a second plate portion 131-2 disposed downstream of the first bearing 110 in the third opposite direction A3*b*. The first plate portion 131-1 has the above-described gap 132-1. The second plate portion 131-2 has a gap 132-2 having the same shape as the gap 132-1.

Figure 7A:
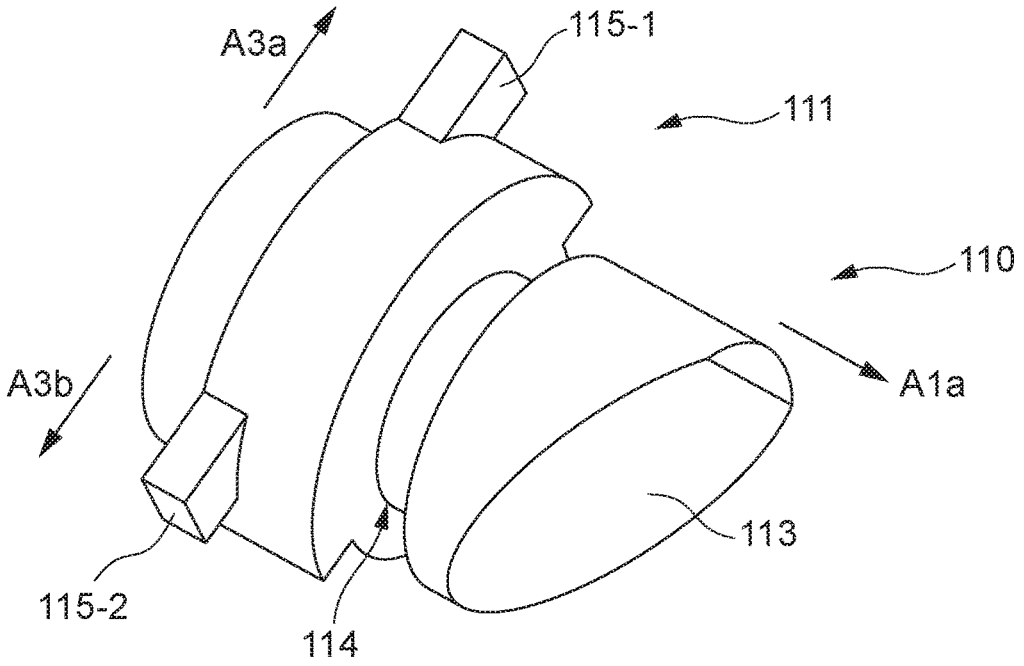
FIGS. 7A and 7B illustrate a first bearing.
Figure 7B:
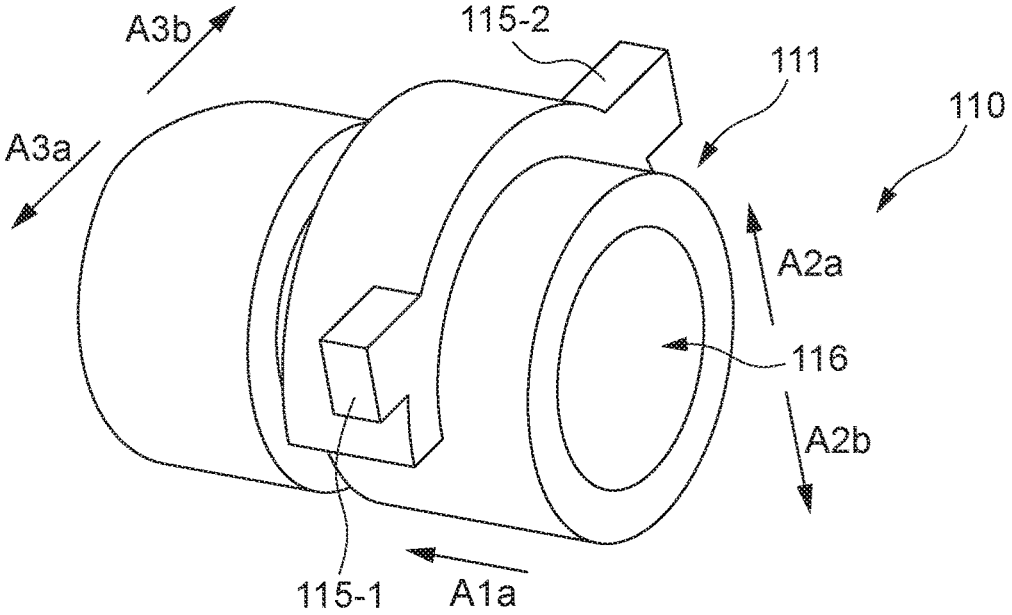
Figure 8:
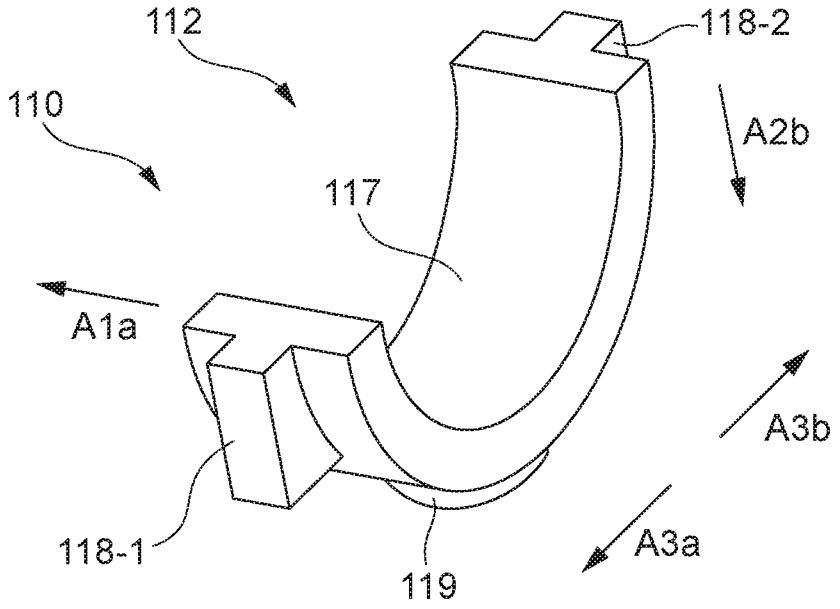
FIG. 8 illustrates the first bearing.

The first projection 115-1 and the second projection 118-1 are inserted in the gap 132-1. Similarly, a first projection 115-2 and a second projection 118-2, which will be described below with reference to FIGS. 7A, 7B, and 8, are inserted in the gap 132-2. The gaps 132-1 and 132-2 in the first passage member 130 define passages along which the above-mentioned projections move.

Figure 6:
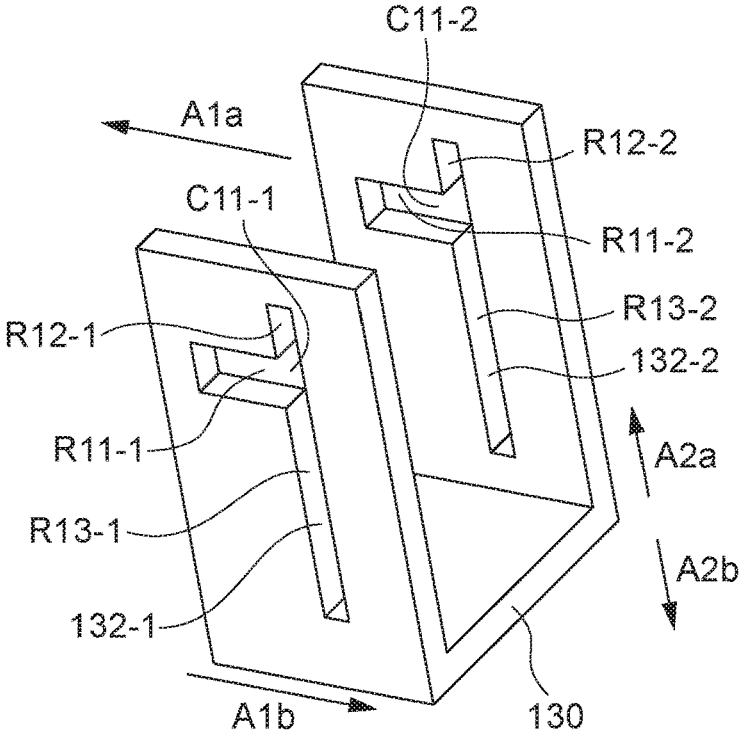
FIG. 6 illustrates passages formed in the first passage member.

FIG. 6 illustrates the passages formed in the first passage member 130. The gap 132-1 includes a first forward passage R11-1 that extends in the first direction A1*a*; a second forward passage R12-1 that extends in the second direction A2*a* from the end of the first forward passage R11-1 in the first opposite direction A1*b*; and a second opposite passage R13-1 that extends in the second opposite direction A2*b* from the end of the first forward passage R11-1 in the first opposite direction A1*b*. The end of the first forward passage R11-1 in the first opposite direction A1*b*, the end of the second forward passage R12-1 in the second opposite direction A2*b*, and the end of the second opposite passage R13-1 in the second direction A2*a* face an intersection space C11-1.

In other words, the first forward passage R11-1 is a passage that extends from the intersection space C11-1 in the first direction A1*a*, the second forward passage R12-1 is a passage that extends from the intersection space C11-1 in the second direction A2*a*, and the second opposite passage R13-1 is a passage that extends from the intersection space C11-1 in the second opposite direction A2*b*. The first forward passage R11-1 is an example of a "first passage" according to the present invention, and the second forward passage R12-1 is an example of a "second passage" according to the present invention.

The gap 132-2 includes a first forward passage R11-2 that extends in the first direction A1*a*; a second forward passage R12-2 that extends in the second direction A2*a* from the end of the first forward passage R11-2 in the first opposite direction A1*b*; and a second opposite passage R13-2 that extends in the second opposite direction A2*b* from the end of the first forward passage R11-2 in the first opposite direction A1*b*. The end of the first forward passage R11-2 in the first opposite direction A1*b*, the end of the second forward passage R12-2 in the second opposite direction A2*b*, and the end of the second opposite passage R13-2 in the second direction A2*a* face an intersection space C11-2.

In other words, the first forward passage R11-2 is a passage that extends from the intersection space C11-2 in the first direction A1*a*, the second forward passage R12-2 is a passage that extends from the intersection space C11-2 in the second direction A2*a*, and the second opposite passage R13-2 is a passage that extends from the intersection space C11-2 in the second opposite direction A2*b*. The first forward passage R11-2 is an example of a "first passage" according to the present invention, and the second forward passage R12-2 is an example of a "second passage" according to the present invention.

The first projection 115-1 and the second projection 118-1 are inserted in the gap 132-1, and the first projection 115-2 and the second projection 118-2 are inserted in the gap 132-2. Thus, the first passage member 130 supports the first bearing 110 in such a manner that the first bearing 110 is movable in the first direction A1*a*, the first opposite direction A1*b*, the second direction A2*a*, and the second opposite direction A2*b*.

FIGS. 7A, 7B, and 8 illustrate the first bearing 110. The first bearing 110 includes a first part 111 illustrated in FIGS. 7A and 7B and a second part 112 illustrated in FIG. 8. The first part 111 includes an inclined surface 113, a groove 114, the first projections 115-1 and 115-2, and a shaft receiving portion 116. FIG. 7A illustrates the first part 111 viewed in a direction such that the inclined surface 113 is visible. The inclined surface 113 is inclined with respect to the first direction A1*a*, and is provided at a side of the first part 111 in the first direction A1*a*.

The groove 114 engages with a portion of the switching member 140 (described in detail below) illustrated in FIGS. 3A and 3B. The first projection 115-1 is provided at the end of the first part 111 in the third direction A3*a*, and is inserted in the gap 132-1 illustrated in FIG. 5 and other drawings. The first projection 115-2 is provided at the end of the first part 111 in the third opposite direction A3*b*, and is inserted in the gap 132-2 illustrated in FIG. 5 and other drawings. The first projections 115-1 and 115-2 are examples of a "projection" according to the present invention. The shaft receiving portion 116 has the shape of a cylinder, and a shaft provided at the end of the first transfer roller 41 in the first direction A1*a* is inserted in the shaft receiving portion 116. The first projections 115-1 and 115-2 are provided on one-half of the outer peripheral surface of the shaft receiving portion 116 in the second direction A2*a*.

The second part 112 illustrated in FIG. 8 includes a contact surface 117, the second projections 118-1 and 118-2, and a spring attachment portion 119. The second part 112 has a shape obtained by cutting a hollow cylinder in half, and the contact surface 117 is the inner peripheral surface of the hollow cylinder. The contact surface 117 is brought into contact with one-half of the outer peripheral surface of the shaft receiving portion 116 of the first part 111 in the second opposite direction A2*b*. Thus, the second part 112 supports the first part 111 in such a manner that the first part 111 is movable in the first direction A1*a* and the first opposite direction A1*b*.

The second projection 118-1 is provided at the end of the second part 112 in the third direction A3*a*, and is inserted in the gap 132-1 illustrated in FIG. 5 and other drawings. The second projection 118-2 is provided at the end of the second part 112 in the third opposite direction A3*b*, and is inserted in the gap 132-2 illustrated in FIG. 5 and other drawings. The spring attachment portion 119 is provided at the end of the second part 112 in the second opposite direction A2*b*, and the first spring 120 illustrated in FIGS. 3A and 3B is attached to the spring attachment portion 119. The first spring 120 urges the spring attachment portion 119 in the second direction A2*a*, so that the entirety of the first bearing 110 is urged in the second direction A2*a*.

Figure 9:
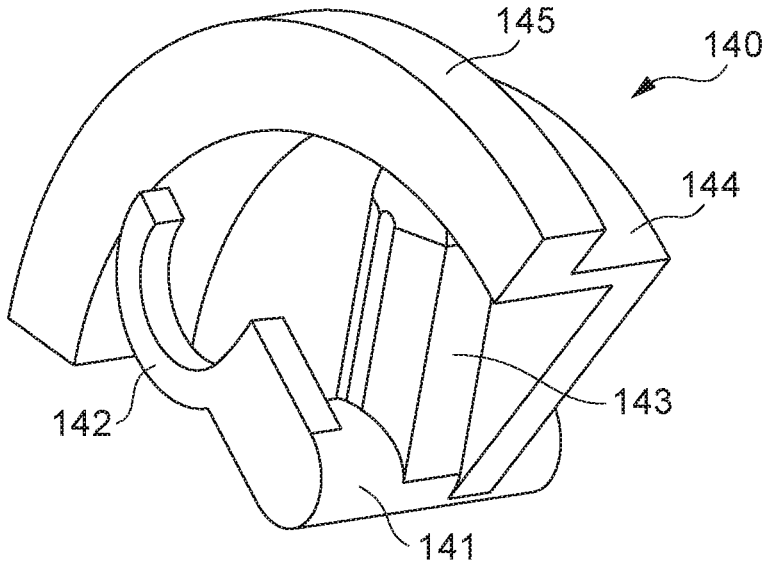
FIG. 9 illustrates a switching member.

FIG. 9 illustrates the switching member 140. The switching member 140 is used to switch between the above-described separated state (state in which the first transfer roller 41 and the photoconductor drum 31 are apart from each other and apply no pressure to each other) and the pressed state (state in which the first transfer roller 41 and the photoconductor drum 31 push each other and apply pressure to each other). As illustrated in FIGS. 3A and 3B, the switching member 140 is disposed downstream of the first bearing 110 in the first direction A1*a*. The switching member 140 includes a cylindrical portion 141, a hook portion 142, a contact portion 143, and an outer peripheral surface portion 144.

The cylindrical portion 141 has the shape of a cylinder, and is supported such that the axis of the cylinder extends in the first direction A1*a* and that the cylindrical portion 141 is rotatable around the axis (rotation axis that extends in the first direction A1*a*). The hook portion 142, the contact portion 143, and the outer peripheral surface portion 144 are connected to the outer periphery of the cylindrical portion 141. These portions may be prepared as separate parts and fixed to the cylindrical portion 141 with an adhesive or the like, or be integrally formed in the shape illustrated in FIG. 9.

The hook portion 142 engages with the groove 114 in the first bearing 110 illustrated in FIGS. 7A and 7B in the separated state. The contact portion 143 comes into contact with the inclined surface 113 of the first bearing 110 illustrated in FIGS. 7A and 7B when the switching member 140 is rotated around the axis of the cylindrical portion 141. The outer peripheral surface portion 144 has an outer peripheral surface 145 around the axis of the cylindrical portion 141. The outer peripheral surface 145 is brought into contact with the outer peripheral surface of the drum gear 32 illustrated in FIGS. 3A and 3B.

When the photoconductor drum 31 and the drum gear 32 rotate, the outer peripheral surface 145 is moved in the rotation direction due to friction between the outer peripheral surface 145 and the drum gear 32. Accordingly, the entirety of the switching member 140 rotates around the axis of the cylindrical portion 141. Thus, the outer peripheral surface portion 144 transmits the rotational force of the photoconductor drum 31, and serves as an example of a "transmitting portion" according to the present invention.

Figure 10A:
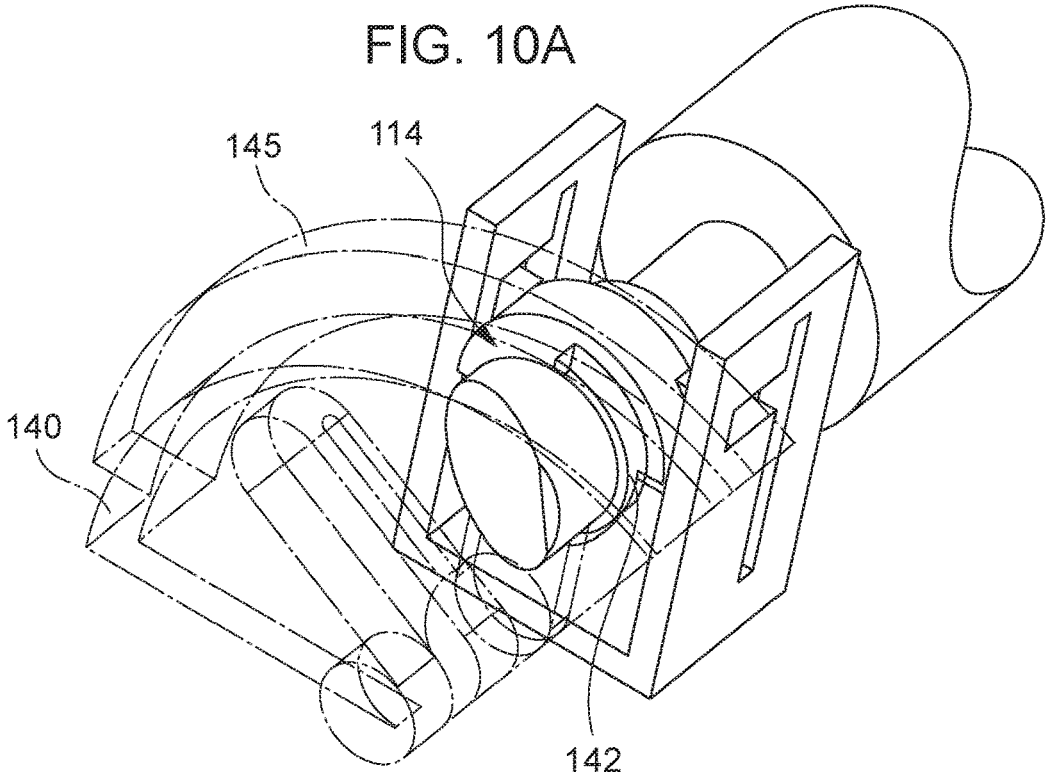
FIGS. 10A and 10B illustrate the switching member in a separated state.
Figure 10B:
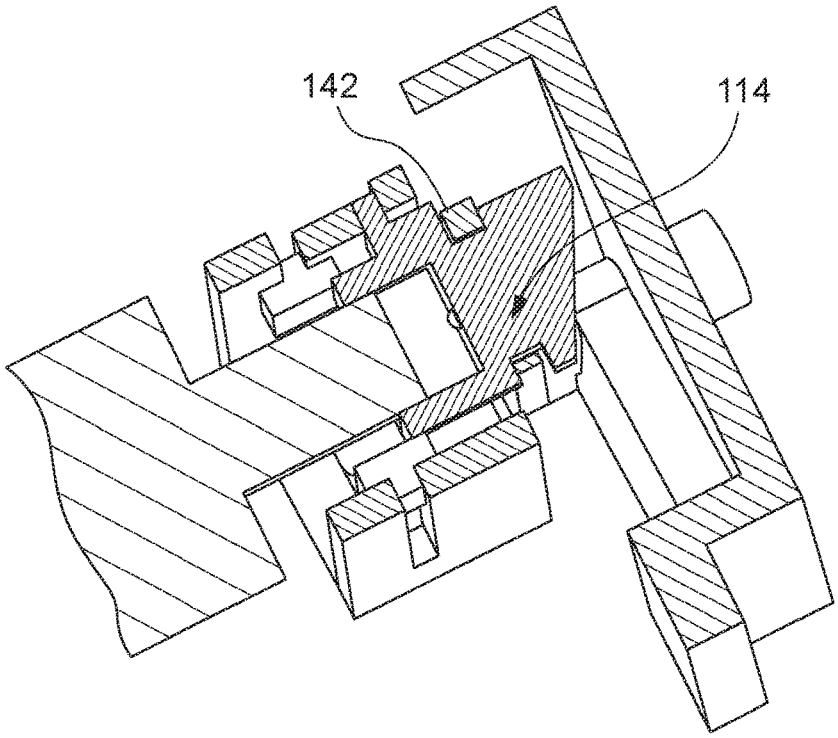

FIGS. 10A and 10B illustrate the switching member 140 in the separated state. FIG. 10A shows a see-through view of the switching member 140 in such a state that the hook portion 142 is engaged with the groove 114 in the first bearing 110. FIG. 10B illustrates a sectional view of the switching member 140 and the first bearing 110 in the same state. In this state, the outer peripheral surface 145 is in contact with the outer peripheral surface of the drum gear 32.

Figure 11A:
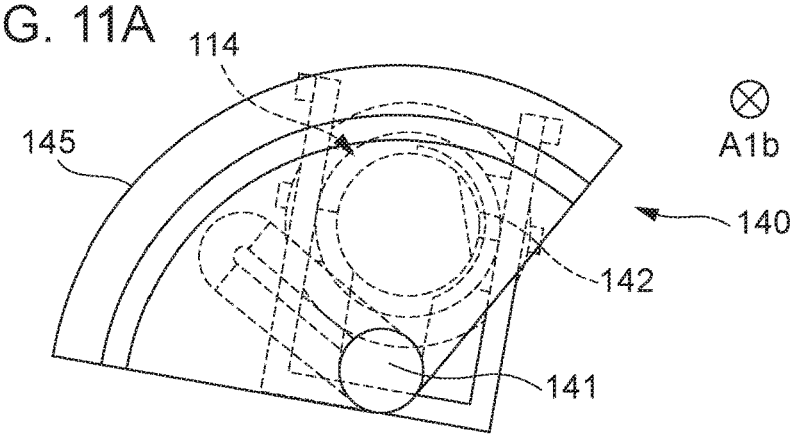
FIGS. 11A, 11B, and 11C illustrate switching from the separated state to a pressed state.
Figure 11B:
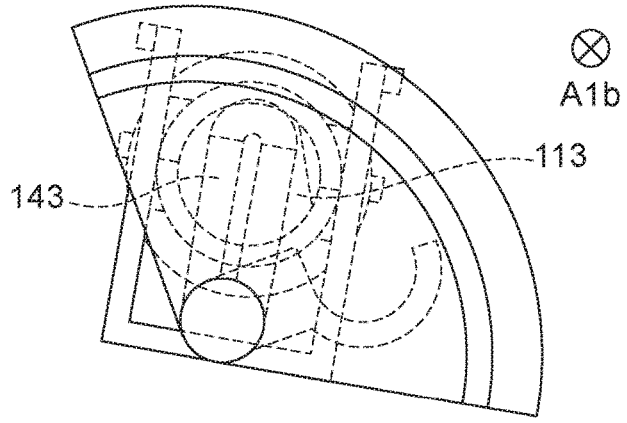
Figure 11C:
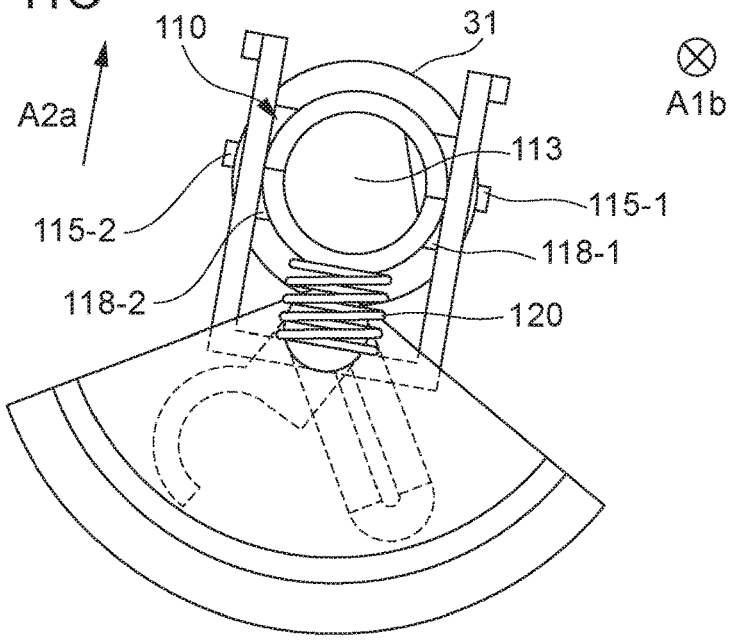

FIGS. 11A, 11B, and 11C illustrate switching from the separated state to the pressed state. FIG. 11A shows a see-through view of the switching member 140 in the separated state (state in which the hook portion 142 is engaged with the groove 114) viewed in the first opposite direction A1*b*. When the drum gear 32 rotates, the outer peripheral surface 145, which is in contact with the drum gear 32, starts to rotate around the axis of the cylindrical portion 141. Accordingly, the entirety of the switching member 140 starts to rotate around the cylindrical portion 141.

FIG. 11B illustrates the switching member 140 in such a state that the switching member 140 has been rotated and the contact portion 143 has been brought into contact with the inclined surface 113 of the first bearing 110. In the separated state, as illustrated in FIG. 5, the first projection 115-1 is in the first forward passage R11-1, and the first projection 115-2 is in the first forward passage R11-2. In this state, the movement direction of the first bearing 110 is limited so that the first bearing 110 does not move in a direction other than the first opposite direction A1*b*. Therefore, the first bearing 110 is moved in the first opposite direction A1*b* by a component of the force applied by the contact portion 143 in the first opposite direction A1*b*.

In FIG. 11C, the switching member 140 has been further rotated, and the contact between the contact portion 143 and the inclined surface 113 has been finished. The amount by which the first bearing 110 is moved in the first opposite direction A1*b* due to the contact between the contact portion 143 and the inclined surface 113 is such that the first projection 115-1 moved along the first forward passage R11-1 reaches the intersection space C11-1 illustrated in FIG. 6 and the first projection 115-2 moved along the first forward passage R11-2 reaches the intersection space C11-2 illustrated in FIG. 6 when the contact is finished.

As described above with reference to FIGS. 3A and 3B, the first bearing 110 is urged in the second direction A2*a* by the first spring 120. Since the second projection 118-1 of the first bearing 110, which is urged in the second direction A2*a*, is in the second opposite passage R13-1, the movement direction thereof is limited so that the second projection 118-1 does not move in a direction other than the second direction A2*a*. Similarly, the movement direction of the second projection 118-2 of the first bearing 110 is also limited so that the second projection 118-2 does not move in a direction other than the second direction A2*a*.

When the first projection 115-1 reaches the intersection space C11-1 and the first projection 115-2 reaches the intersection space C11-2, the first projection 115-1 becomes movable in the second direction A2*a* along the second forward passage R12-1, and the first projection 115-2 becomes movable in the second direction A2*a* along the second forward passage R12-2. Therefore, the first bearing 110 is moved together with the projections in the second direction A2*a* by the force applied by the first spring 120.

Thus, when the switching member 140 rotates, the switching member 140 applies force in the first opposite direction A1*b* to the first bearing 110 to move the first projections 115-1 and 115-2 in the first forward passages R11-1 and R11-2, respectively, to the second forward passages R12-1 and R12-2, respectively. The switching member 140 is an example of a "rotating member" according to the present invention.

When the first bearing 110 is moved, the first transfer roller 41 is also moved in the second direction A2*a* so that the pressed state, in which the first transfer roller 41 and the photoconductor drum 31 push each other and apply pressure to each other, is established. Thus, the first passage member 130 is fixed at a position such that the separated state is established when the first projections 115-1 and 115-2 are in the first forward passages R11-1 and R11-2, respectively, and that the first bearing 110, which is urged, is moved in the second direction A2*a* to establish the pressed state when the first projections 115-1 and 115-2 are in the second forward passages R12-1 and R12-2, respectively.

Figure 12:
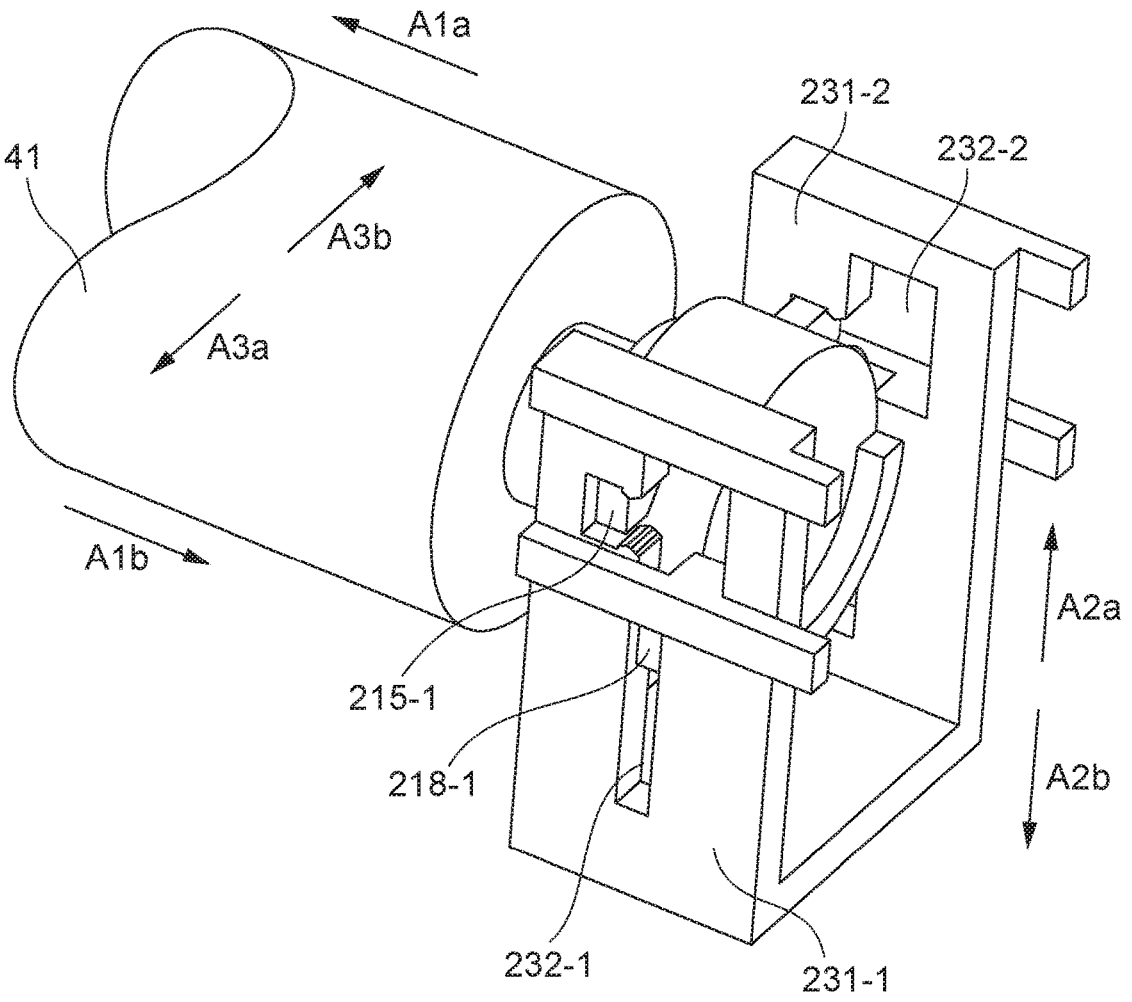
FIG. 12 is an enlarge view of a second passage member.

FIG. 12 is an enlarged view of the second passage member 230. The second passage member 230 includes a first plate portion 231-1 disposed downstream of the second bearing 210 in the third direction A3*a* and a second plate portion 231-2 disposed downstream of the second bearing 210 in the third opposite direction A3*b*. The first plate portion 231-1 has the gap 232-1 described above with reference to FIGS. 3A and 3B. The second plate portion 231-2 has a gap 232-2 having the same shape as the gap 232-1.

Figure 14A:
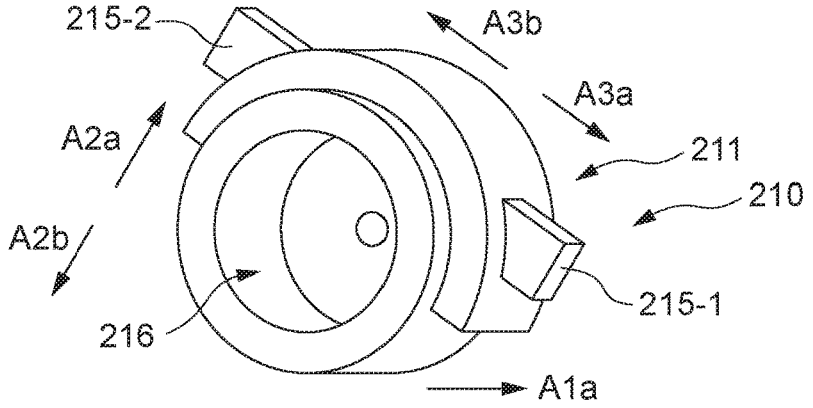
FIGS. 14A and 14B illustrates a second bearing.
Figure 14B:
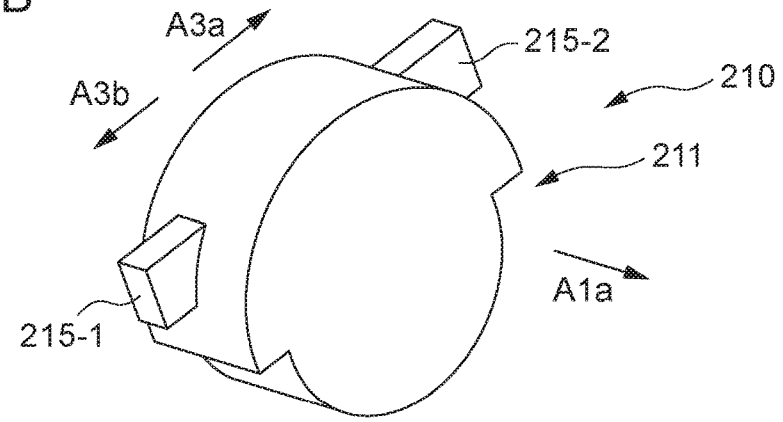
Figure 15:
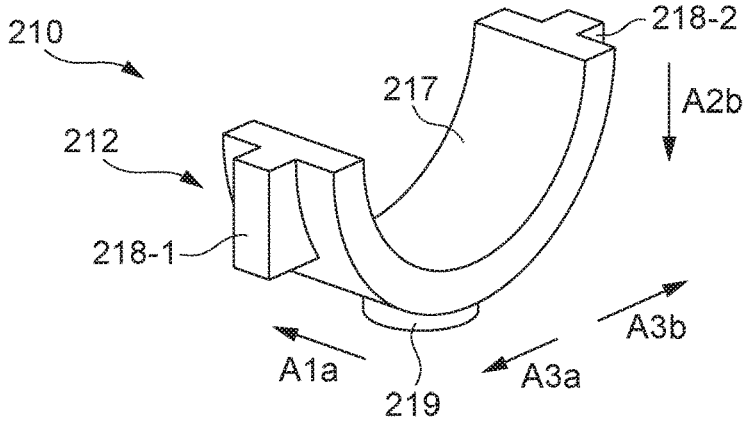
FIG. 15 illustrates the second bearing.

The first projection 215-1 and the second projection 218-1 are inserted in the gap 232-1. Similarly, a first projection 215-2 and a second projection 218-2, which will be described below with reference to FIGS. 14A, 14B, and 15, are inserted in the gap 232-2. The gaps 232-1 and 232-2 in the second passage member 230 define passages along which the above-mentioned projections move.

Figure 13A:
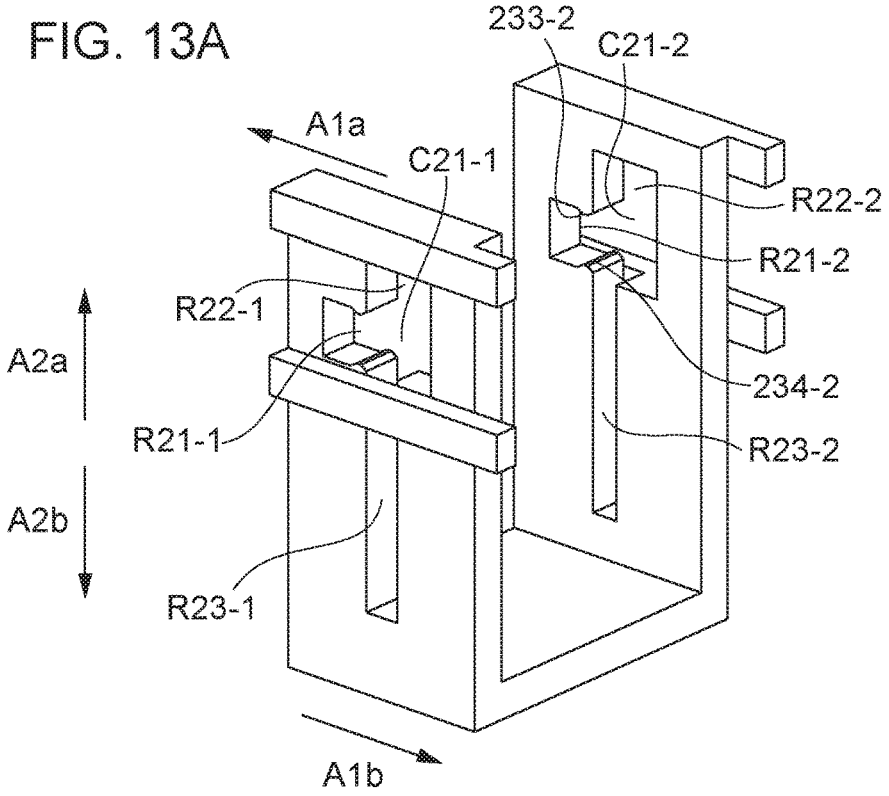
FIGS. 13A and 13B illustrate passages formed in the second passage member.
Figure 13B:
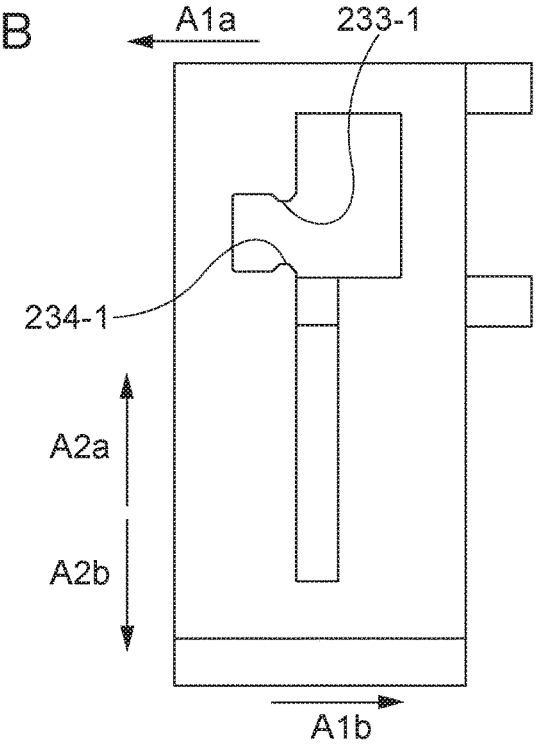

FIGS. 13A and 13B illustrate the passages formed in the second passage member 230. The gap 232-1 includes a first forward passage R21-1 that extends in the first direction A1*a*; a second forward passage R22-1 that extends in the second direction A2*a* from the end of the first forward passage R21-1 in the first opposite direction A1*b*; and a second opposite passage R23-1 that extends in the second opposite direction A2*b* from the end of the first forward passage R21-1 in the first opposite direction A1*b*. The end of the first forward passage R21-1 in the first opposite direction A1*b*, the end of the second forward passage R22-1 in the second opposite direction A2*b*, and the end of the second opposite passage R23-1 in the second direction A2*a* face an intersection space C21-1.

In other words, the first forward passage R21-1 is a passage that extends from the intersection space C21-1 in the first direction A1*a*, the second forward passage R22-1 is a passage that extends from the intersection space C21-1 in the second direction A2*a*, and the second opposite passage R23-1 is a passage that extends from the intersection space C21-1 in the second opposite direction A2*b*. The first forward passage R21-1 is an example of a "third passage" according to the present invention, and the second forward passage R22-1 is an example of a "fourth passage" according to the present invention.

The gap 232-2 includes a first forward passage R21-2 that extends in the first direction A1*a*; a second forward passage R22-2 that extends in the second direction A2*a* from the end of the first forward passage R21-2 in the first opposite direction A1*b*; and a second opposite passage R23-2 that extends in the second opposite direction A2*b* from the end of the first forward passage R21-2 in the first opposite direction A1*b*. The end of the first forward passage R21-2 in the first opposite direction A1*b*, the end of the second forward passage R22-2 in the second opposite direction A2*b*, and the end of the second opposite passage R23-2 in the second direction A2*a* face an intersection space C21-2.

In other words, the first forward passage R21-2 is a passage that extends from the intersection space C21-2 in the first direction A1*a*, the second forward passage R22-2 is a passage that extends from the intersection space C21-2 in the second direction A2*a*, and the second opposite passage R23-2 is a passage that extends from the intersection space C21-2 in the second opposite direction A2*b*. The first forward passage R21-2 is an example of a "third passage" according to the present invention, and the second forward passage R22-2 is an example of a "fourth passage" according to the present invention.

The first projection 215-1 and the second projection 218-1 are inserted in the gap 232-1, and the first projection 215-2 and the second projection 218-2 are inserted in the gap 232-2. Thus, the second passage member 230 supports the second bearing 210 in such a manner that the second bearing 210 is movable in the first direction A1*a*, the first opposite direction A1*b*, the second direction A2*a*, and the second opposite direction A2*b*.

The first plate portion 231-1 includes protrusions 233-1 and 234-1 that protrude in the second direction A2*a* and that are formed in the first forward passage R21-1. The first plate portion 231-2 includes protrusions 233-2 and 234-2 that protrude in the second direction A2*a* and that are formed in the first forward passage R21-2. The protrusion 233-1 is provided at a side of the first forward passage R21-1 in the second direction A2*a*, and the protrusion 233-2 is provided at a side of the first forward passage R21-2 in the second direction A2*a*.

FIGS. 14A, 14B, and 15 illustrate the second bearing 210. The second bearing 210 includes a first part 211 illustrated in FIGS. 14A and 14B and a second part 212 illustrated in FIG. 15. The first part 211 includes the first projections 215-1 and 215-2 and a shaft receiving portion 216. FIG. 14A illustrates the first part 211 viewed in a direction such that the shaft receiving portion 216 is visible.

The first projection 215-1 is provided at the end of the first part 211 in the third direction A3*a*, and is inserted in the gap 232-1 illustrated in FIG. 12 and other drawings. The first projection 215-2 is provided at the end of the first part 211 in the third opposite direction A3*b*, and is inserted in the gap 232-2 illustrated in FIG. 12 and other drawings. The first projections 215-1 and 215-2 are examples of a "second projection" according to the present invention. The shaft receiving portion 216 has the shape of a cylinder, and a shaft provided at the end of the first transfer roller 41 in the first opposite direction A1*b* is inserted in the shaft receiving portion 216. The first projections 215-1 and 215-2 are provided on one-half of the outer peripheral surface of the shaft receiving portion 216 in the second direction A2*a*.

The second part 212 illustrated in FIG. 15 includes a contact surface 217, the second projections 218-1 and 218-2, and a spring attachment portion 219. The second part 212 has a shape obtained by cutting a hollow cylinder in half, and the contact surface 217 is the inner peripheral surface of the hollow cylinder. The contact surface 217 is brought into contact with one-half of the outer peripheral surface of the shaft receiving portion 216 of the first part 211 in the second opposite direction A2*b*. Thus, the second part 212 supports the first part 211 in such a manner that the first part 211 is movable in the first direction A1*a* and the first opposite direction A1*b*.

The second projection 218-1 is provided at the end of the second part 212 in the third direction A3*a*, and is inserted in the gap 232-1 illustrated in FIG. 12 and other drawings. The second projection 218-2 is provided at the end of the second part 212 in the third opposite direction A3*b*, and is inserted in the gap 232-2 illustrated in FIG. 12 and other drawings. The spring attachment portion 219 is provided at the end of the second part 212 in the second opposite direction A2*b*, and the second spring 220 illustrated in FIGS. 3A and 3B is attached to the spring attachment portion 219. The second spring 220 urges the spring attachment portion 219 in the second direction A2*a*, so that the entirety of the second bearing 210 is urged in the second direction A2*a*.

As described above with reference to FIGS. 11A to 11C, when the switching member 140 is rotated and applies force in the first opposite direction A1*b* to the first bearing 110, the first transfer roller 41 and the second bearing 210 are moved in the first opposite direction A1*b* together with the first bearing 110. The amount by which the second bearing 210 is moved in the first opposite direction A1*b* is such that the first projection 215-1 moved along the first forward passage R21-1 reaches the intersection space C21-1 and the first projection 215-2 moved along the first forward passage R21-2 reaches the intersection space C21-2.

As described above with reference to FIGS. 3A and 3B, the second bearing 210 is urged in the second direction A2*a* by the second spring 220. Since the second projection 218-1 of the second bearing 210, which is urged in the second direction A2*a*, is in the second opposite passage R23-1, the movement direction thereof is limited so that the second projection 218-1 does not move in a direction other than the second direction A2*a*. Similarly, the movement direction of the second projection 218-2 of the second bearing 210 is also limited so that the second projection 218-2 does not move in a direction other than the second direction A2*a*.

When the first projection 215-1 reaches the intersection space C21-1 and the first projection 215-2 reaches the intersection space C21-2, the first projection 215-1 becomes movable in the second direction A2*a* along the second forward passage R22-1, and the first projection 215-2 becomes movable in the second direction A2*a* along the second forward passage R22-2. Therefore, the second bearing 210 is moved together with the projections in the second direction A2*a* by the force applied by the second spring 220.

When the second bearing 210 is moved, the first transfer roller 41 is also moved in the second direction A2*a* so that the pressed state, in which the first transfer roller 41 and the photoconductor drum 31 push each other and apply pressure to each other, is established. Thus, the second passage member 230 is fixed at a position such that the separated state is established when the first projections 215-1 and 215-2 are in the first forward passages R21-1 and R21-2, respectively, and that the second bearing 210, which is urged, is moved in the second direction A2*a* to establish the pressed state when the first projections 215-1 and 215-2 are in the second forward passages R22-1 and R22-2, respectively.

As illustrated in FIGS. 3A and 3B, the first transfer roller 41 is displaced in the axial direction (direction along the first direction A1*a* and the first opposite direction A1*b*) so that the first transfer roller 41 is maintained apart from the photoconductor drum 31. The first transfer roller 41 is positioned such that the axial direction thereof is horizontal to ensure stable operation when used. The first bearing 110 and the second bearing 210, which support the first transfer roller 41, respectively receive force from the first spring 120 and the second spring 220 in the second direction A2*a*, which is perpendicular to the axial direction.

Referring to FIGS. 5, 12, 13A, and 13B, in the separated state, the first projections 115-1, 115-2, 215-1, and 215-2 are respectively disposed in the first forward passages R11-1, R11-2, R21-1, and R21-2. Although the first projections receive the force from the above-described springs and are urged in the second direction A2*a*, the first forward passages all extend in the first direction A1*a*.

Therefore, wall surfaces that define the first forward passage (the first passage member 130 and the second passage member 230) receive force from the projections in a direction perpendicular thereto. Accordingly, the first transfer roller 41 maintained in the separated state receives no force in the first opposite direction A1*b*, that is, in the direction in which the first projections are moved toward the second forward passages R12-1, R12-2, R22-1, and R22-2, at both ends of the first transfer roller 41.

The protrusions 233-1, 234-1, 233-2, and 234-2 illustrated in FIGS. 13A and 13B are formed in the first forward passages in the second passage member 230. Even when the first transfer roller 41 receives force in the first opposite direction A1*b* during transportation of the image forming apparatus 1, the protrusions catch the first projections. Accordingly, the risk that the first projections will move to the second forward passages is lower than that in the case where no protrusions are formed. In other words, the separated state is not easily canceled.

As described above, the first projections are urged in the second direction A2*a*. Therefore, when the protrusions 233-1 and 233-2 are formed at the sides of the first forward passages in the second direction A2*a*, the risk that the separated state will be cancelled is lower than that in the case where the protrusions are provided only at the other sides.

In the present exemplary embodiment, the switching member 140 rotates to cancel the separated state and establish the pressed state. Accordingly, it is not necessary for an operator to touch the first transfer roller 41, the first bearing 110, or the second bearing 210, so that these components are prevented from being damaged when the separated state is canceled. Also, since the switching member 140 rotates in response to rotation of the photoconductor drum 31 and the drum gear 32, the separated state is cancelled when the photoconductor drum 31 starts being used.

In addition, in the present exemplary embodiment, each of the bearings (first bearing 110 and second bearing 210) includes two parts (first part and second part). Although the first parts, which have the first projections, move in the axial direction, the second parts, which have the second projections and spring attachment portions, do not move in the axial direction. Since the movement direction of the second parts is limited so that the second projections do not move in the axial direction, the positions at which the springs (first spring 120 and second spring 220) apply force in the second direction A2*a* do not shift in the axial direction. Therefore, the force applied by the springs may be more efficiently transmitted to the bearings than in the case where the positions at which the force is applied are shifted in the axial direction and the springs are bent from the upright position.

2. Modification

The above-described exemplary embodiment is merely an example of the present invention, and may be modified as follows. The exemplary embodiment and modifications may be applied in combination with each other as necessary.

2-1. Protrusions and Recesses

Although the first forward passages R21-1 and R21-2 of the second passage member 230 have protrusions (233-1, for example) in the above-described exemplary embodiment, the first forward passages R11-1 and R11-2 of the first passage member 130 may instead be provided with protrusions. Also in that case, the risk that the separated state will be cancelled is lower than that in the case where no protrusions are provided. The first forward passages may have recesses instead of the protrusions. In such a case, the first projections will be caught by the recesses when moved in the first opposite direction A1*b*. Therefore, the risk that the first projections will move to the second forward passages is lower than that in the case where no recesses are formed.

2-2. Restricting Member

In the above-described examples, the protrusions or recesses are formed in the first forward passages to restrict the movement of the bearings (first bearing 110 and second bearing 210), which include the first projections, in the first opposite direction A1*b*. However, movement of a shaft of the first transfer roller 41 in the first opposite direction A1*b* may instead be restricted.

Figure 16A:
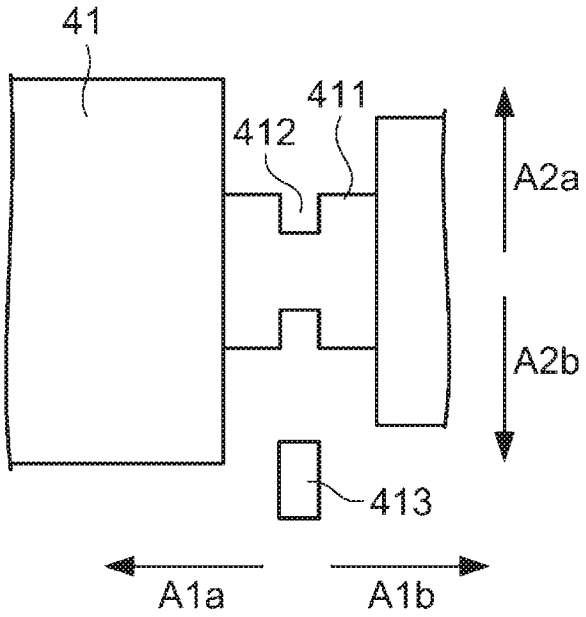
FIGS. 16A, 16B, and 16C illustrate an example of a restricting member.
Figure 16B:
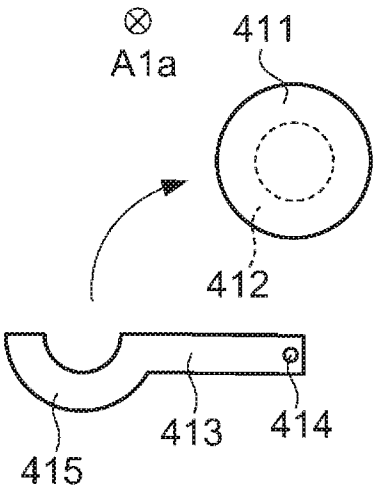
Figure 16C:
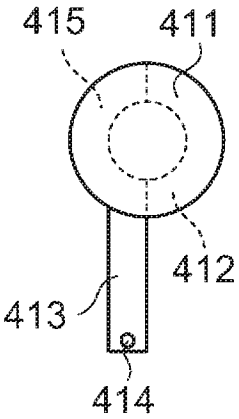

FIGS. 16A, 16B, and 16C illustrate an example of a restricting member. FIGS. 16A, 16B, and 16C illustrate a shaft 411 of the first transfer roller 41, a recess 412 formed in an outer peripheral surface of the shaft 411, and a restricting member 413. As illustrated in FIG. 16A, the restricting member 413 is disposed downstream of the recess 412 in the second opposite direction A2*b*. FIG. 16B illustrates the shaft 411 and the restricting member 413 viewed in the first direction A1*a*.

The restricting member 413 is a rod-shaped member including a rotating shaft 414 at one end and a curved portion 415 at the other end. The restricting member 413 is supported such that restricting member 413 is rotatable around the rotating shaft 414. The curved portion 415 is shaped to be engageable with the recess 412. When the restricting member 413 rotates around the rotating shaft 414, the curved portion 415 engages with the recess 412, as illustrated in FIG. 16C.

When the curved portion 415 engages with the recess 412, movement of the shaft 411 in the first opposite direction A1*b* is restricted. In other words, movement of the first transfer roller 41 in the first opposite direction A1*b* is restricted. Thus, the restricting member 413 is supported such that the curved portion 415 is movable, and comes into contact with the recess 412 to restrict movement of the first transfer roller 41 in the first opposite direction A1*b* when the curved portion 415 is moved in the separated state.

The outer peripheral surface of the shaft of the first transfer roller 41 may have a protrusion instead of the recess. In such a case, for example, the curved portion of the restricting member may be shaped such that the curved portion comes into contact with the outer peripheral surface of the shaft, and the restricting member may be disposed so that the curved portion comes into contact with the outer peripheral surface of the shaft at a position downstream of the protrusion in the first opposite direction A1*b*. In either case, even when a force in the first opposite direction A1*b* is applied to the first transfer roller 41, the risk that the separated state will be cancelled is lower than that in the case where no restricting member is provided.

2-3. Roller Device

In the exemplary embodiment, the present invention is applied to a roller device including two rollers which are the photoconductor drum 31 and the first transfer roller 41. However, the present invention is not limited to this, and may instead be applied to a roller device including two rollers which are, for example, a second transfer roller and a backup roller. In such a case, the second transfer roller is an example of a "first roller" according to the present invention, and the backup roller is an example of a "second roller" according to the present invention.

The present invention may also be applied to a roller device of an image forming apparatus in which an image is directly transferred from a photoconductor drum 31 to a medium (for example, a monochrome device), the roller device including two rollers which are the photoconductor drum 31 and a transfer roller (an example of a "second roller" according to the present invention). In such a case, an image forming unit included in the image forming apparatus forms an image on the medium by applying a transfer voltage between the photoconductor drum 31 and the transfer roller so that the image formed on the photoconductor drum 31 is transferred to the medium transported while being nipped between the photoconductor drum 31 and the transfer roller.

In each of the above-described examples, the "first roller" and the "second roller" may be switched. For example, in the roller device according to the exemplary embodiment, the first transfer roller 41 may be an example of the "first roller" according to the present invention, and the photoconductor drum 31 may be an example of a "second roller" according to the present invention. In this case, the photoconductor drum 31 is provided with bearings having projections and is urged in the second direction (direction toward the first transfer roller 41). In the case where the fixing unit includes two rollers, the present invention may be applied to the fixing unit, which serves as a roller device. The present invention may also be applied to a roller device including two rollers that is included in an apparatus other than the image forming apparatus (for example, a transport apparatus or a post-processing apparatus). The present invention may be applied to any roller device as long as two rollers included therein are to be switched from the separated state to the pressed state.

2-4. Bearings

In the exemplary embodiment, each of the bearings (first bearing 110 and second bearing 210) includes two parts. However, the bearings are not limited to this, and each bearing may instead be composed of a single part or three or more parts. In addition, in the exemplary embodiment, each bearing includes the first projections that move along the first forward passages and the second forward passages and the second projections that move along the second opposite passages. However, the bearings are not limited to this, and each bearing may instead include only the first projections. Also in this case, the first transfer roller 41 is maintained apart from the photoconductor drum 31 by disposing the first projections in the first forward passages, that is, by displacing the first transfer roller 41 in the axial direction.

2-5. Passage Members

The passage members (first passage member 130 and second passage member 230) may have shapes different from those in the exemplary embodiment. For example, although the gaps (gap 132-1, for example) that define the passages extend through the plate portions (first plate portion 131-1, for example) as illustrated in FIG. 5 and other drawings in the exemplary embodiment, the gaps may instead be grooves formed in the plate portions.

In addition, although the passage members have the first forward passages, the second forward passages, and the second opposite passages, it is not necessary to form the second opposite passages as long as at least the first forward passages and the second forward passages are formed. Also in that case, the above-described first projections move along the first forward passages and the second forward passages. Accordingly, the first transfer roller 41 is maintained apart from the photoconductor drum 31, and when the first projections reach the second forward passages, the first projections are moved in the second direction A2*a* by the force applied by the springs and the first transfer roller 41 is pressed against the photoconductor drum 31.

2-6. First Forward Passages

Although the first forward passages extend linearly in the first direction A1*a* in the exemplary embodiment, the first forward passages are not limited to this, and may instead be curved or inclined with respect to the first direction A1*a* (so as to be gradually shifted in the second direction A2*a* with increasing distance from the intersection spaces) in intermediate regions thereof. There is no particular limitation regarding the first forward passages as long as wall surfaces of at least portions the first forward passages at the sides in the second direction A2*a* extend in the first direction A1*a* or are inclined with respect to the first direction A1*a* (so as to be gradually shifted in the second direction A2*a* with increasing distance from the intersection spaces).

When the first projections are on the above-described wall surfaces in the separated state, even when the bearings receive force in the second direction A2*a* from the springs, no force component in the first opposite direction A1*b* is generated at the contact portions between the first projections and the wall surfaces. Therefore, as in the exemplary embodiment, no force is applied to the bearings and the first transfer roller 41 in the first opposite direction A1*b*. As described above, the first forward passages may include portions having inclined wall surfaces as described above as long as they extend in the first direction A1*a* on the whole. However, the angle of the inclined wall surfaces with respect to the first direction A1*a* may be set to a small angle because the first projections need to be moved in the first opposite direction A1*b* when the separated state is to be canceled. If this angle is large, the first projections receive a large resistance when moved in the first opposite direction A1*b*.

2-7. Urging Units

In the exemplary embodiment, the bearings (first bearing 110 and second bearing 210) are urged in the second direction A2*a* by the first spring 120 and the second spring 220, which are coil springs. However, the urging units are not limited to this, and the bearings may instead be urged by using, for example, other types of springs, such as leaf springs and disc springs, or oil pressure. Any type of urging units may be used as long as force may be applied to the bearings in the second direction A2*a*.

2-8. Switching Member

The switching member may have a structure different from that in the exemplary embodiment. For example, the switching member may receive a rotational force from the drum gear 32 through a belt or the like instead of being rotated while being in direct contact with the drum gear 32. Alternatively, the switching member may be provided with a lever or the like, and be manually rotated by an operator instead of receiving a rotational force from the drum gear 32. The roller device may include no switching member. In such a case, the operator may manually move the first projections in the first opposite direction A1*b* to cancel the separated state.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A roller device comprising:

a first roller;

a second roller that rotates around a rotation axis extending in a first direction and that is disposed upstream of the first roller in a second direction;

a bearing that supports an end of the second roller in a rotatable manner and that includes a projection;

an urging unit that urges the bearing in the second direction; and a passage member having a gap that defines a first passage that extends in the first direction and a second passage that is connected to an end of the first passage in a direction opposite to the first direction and that extends in the second direction, the passage member supporting the bearing in such a manner that the projection is inserted in the gap and that the bearing is movable in the first direction and the second direction, the passage member being fixed at a position such that the first and second rollers are apart from each other when the projection is in the first passage and that the bearing, which is urged, is moved in the second direction so that the first and second rollers are pressed against each other when the projection is in the second passage.

2. The roller device according to claim 1, wherein the first passage has a protrusion that protrudes in the second direction or a recess that is recessed in the second direction.

3. The roller device according to claim 2, wherein the protrusion or the recess is formed at a side of the first passage in the second direction.

4. The roller device according to claim 2, wherein the bearing supports an end of the second roller in the first direction, and wherein the roller device further comprises a rotating member disposed downstream of the bearing in the first direction, the rotating member applying force to the bearing in the direction opposite to the first direction so that the projection in the first passage moves to the second passage when the rotating member rotates.

5. The roller device according to claim 4, wherein the bearing includes an inclined surface at a side of the bearing in the first direction, the inclined surface being inclined with respect to the first direction, and wherein the rotating member includes a contact portion that comes into contact with the inclined surface when the rotating member rotates around the rotation axis that extends in the first direction.

6. The roller device according to claim 4, wherein the rotating member includes a transmitting portion that transmits a rotational force of the first roller, the rotating member rotating in response to rotation of the first roller when the first roller rotates.

7. The roller device according to claim 1, wherein the second roller includes a shaft having a recess or a protrusion on an outer peripheral surface of the shaft, and wherein the roller device further comprises a restricting member that is movably supported and that comes into contact with the recess or the protrusion and restricts movement of the second roller in the direction opposite to the first direction when the restricting member is moved while the projection of the bearing is in the first passage.

8. The roller device according to claim 1, further comprising:

a second bearing that supports the other end of the second roller in a rotatable manner and that includes a second projection;

a second urging unit that urges the second bearing in the second direction; and a second passage member having a gap that defines a third passage that extends in the first direction and a fourth passage that is connected to an end of the third passage in the direction opposite to the first direction and that extends in the second direction, the second passage member supporting the second bearing in such a manner that the second projection is inserted in the gap and that the second bearing is movable in the first direction and the second direction, the second passage member being fixed at a position such that the first and second rollers are apart from each other when the second projection is in the third passage and that the second bearing, which is urged, is moved in the second direction so that the first and second rollers are pressed against each other when the second projection is in the fourth passage.

9. An image forming apparatus comprising:

the roller device according to claim 1;

a transfer belt that rotates while being nipped by the first roller and the second roller; and an image forming unit that forms an image on a medium by forming the image on the first roller, transferring the image to the transfer belt by applying a transfer voltage between the first roller and the second roller, and transferring the image transferred to the transfer belt to the medium.

10. An image forming apparatus, comprising:

the roller device according to claim 1; and an image forming unit that forms an image on a medium by forming the image on the first roller and transferring the image to a medium by applying a transfer voltage between the first roller and the second roller, the medium being transported while being nipped by the first roller and the second roller.

11. An image forming apparatus comprising:

the roller device according to claim 1;

a transfer belt that rotates while being nipped by the first roller and the second roller; and an image forming unit that forms an image on a medium by forming the image on the transfer belt and transferring the image to the medium by applying a transfer voltage between the first roller and the second roller.

* * * * *